US006885840B2

(12) United States Patent
Huang et al.

(10) Patent No.: US 6,885,840 B2
(45) Date of Patent: Apr. 26, 2005

(54) TONER CONTAINER AND A REMOVABLE LID FOR USE THEREWITH

(75) Inventors: Ya-Li Huang, Taichung (TW); Kuan-Tung Li, Yunlin (TW); Min-Yao Hsieh, Dacheng (TW)

(73) Assignee: General Plastic Industrial Co., Ltd. (TW)

( * ) Notice: Subject to any disclaimer, the term of this patent is extended or adjusted under 35 U.S.C. 154(b) by 16 days.

(21) Appl. No.: 10/603,875

(22) Filed: Jun. 25, 2003

(65) Prior Publication Data

US 2004/0265013 A1 Dec. 30, 2004

(51) Int. Cl.[7] ..... G03G 15/08
(52) U.S. Cl. ..... 399/262; 399/119
(58) Field of Search ..... 399/262, 258, 399/260, 119

(56) References Cited

U.S. PATENT DOCUMENTS

| | | | | |
|---|---|---|---|---|
| 1,553,613 A | | 9/1925 | Holthoff | |
| 2,746,632 A | | 5/1956 | Bramming | 215/52 |
| 2,965,266 A | | 12/1960 | Rutkus, Jr. et al. | 222/70 |
| 3,382,887 A | | 5/1968 | Erickson | 137/263 |
| 3,853,246 A | | 12/1974 | Dubois | 222/168 |
| 3,915,340 A | | 10/1975 | Koeleman | 222/23 |
| 3,979,026 A | | 9/1976 | Lee | 222/167 |
| 4,212,264 A | | 7/1980 | Knechtel et al. | 118/653 |
| 4,611,730 A | | 9/1986 | Ikesue et al. | 222/167 |
| 4,641,945 A | | 2/1987 | Ikesue et al. | 355/3 DD |
| 4,744,493 A | | 5/1988 | Ikesue et al. | 222/167 |
| 4,949,123 A | | 8/1990 | Takashima | 355/260 |
| 5,049,941 A | | 9/1991 | Manno et al. | 355/260 |
| 5,078,303 A | | 1/1992 | Kikuchi et al. | 222/167 |
| 5,218,407 A | | 6/1993 | Matsushita et al. | 355/208 |
| 5,257,077 A | | 10/1993 | Peters, Jr. et al. | 355/260 |
| 5,293,913 A | | 3/1994 | Preszler | 141/367 |
| 5,296,900 A | | 3/1994 | Saijo et al. | 355/260 |
| 5,307,129 A | | 4/1994 | Miura et al. | 355/260 |
| 5,455,662 A | | 10/1995 | Ichikawa et al. | 355/260 |
| 5,489,976 A | | 2/1996 | Ichikawa | 355/260 |
| 5,500,719 A | | 3/1996 | Ichikawa et al. | 355/260 |
| 5,627,631 A | | 5/1997 | Ichikawa et al. | 355/260 |
| 5,655,195 A | | 8/1997 | Ichikawa et al. | 399/263 |
| 5,822,663 A | | 10/1998 | Ichikawa et al. | 399/262 |
| 5,828,935 A | | 10/1998 | Tatsumi et al. | 399/260 |
| 5,918,090 A | * | 6/1999 | Ichikawa et al. | 399/120 |
| 6,075,963 A | | 6/2000 | Ichikawa et al. | 399/262 |
| 6,289,195 B1 | | 9/2001 | Ichikawa et al. | 399/262 |
| 6,418,293 B1 | | 7/2002 | Ichikawa et al. | 399/262 |

FOREIGN PATENT DOCUMENTS

| | | | |
|---|---|---|---|
| JP | 60243681 | 12/1982 | G03G/15/03 |

* cited by examiner

*Primary Examiner*—Quana Grainger
(74) *Attorney, Agent, or Firm*—Morris, Manning & Martin, LLP; Tim Tingkang Xia, Esq.

(57) ABSTRACT

A lid to selectively plug or unplug a discharge mouth of a developer container mounted to an image forming apparatus for replenishing a developer. In one embodiment of the present invention, the lid includes a body having a bottom portion and a sidewall portion defining an opening, wherein the bottom portion has an inner surface and an outer surface, and the sidewall portion has an inner surface and an outer surface. The lid additionally includes a lug having a first end and a second end defining a body portion, wherein the lug is engaged with the body at a position at the sidewall portion such that the second end of the lug and the first surface of the bottom portion define a gap g therebetween and the body portion of the lug facing away from the developer container when the lid plugs the discharge mouth.

20 Claims, 11 Drawing Sheets

TONER CONTAINER AND A REMOVABLE LID FOR USE THEREWITH

BACKGROUND OF THE INVENTION

1. Field of the Invention

The present invention relates to a toner supply container for replenishing toner into an image forming apparatus such as an electrophotographic copying machine or a printer, and more particularly, to a toner supply container for replenishing toner into an image forming apparatus, that has a lid selectively plug or unplug a discharge mouth of a developer container mounted to an image forming apparatus for replenishing a developer.

2. Background

Heretofore, toner in the form of fine particles is used as a developer in the image forming apparatus such as an electrophotographic copying machine or a printer. When the developer in a main assembly of the image forming apparatus is used, the toner is supplied into the image forming apparatus using a toner supply container.

When the toner is used up, a new toner supply container or toner bottle with a supply of the toner is provided to replace the toner supply container, which then is discarded. FIG. 1 shows a specific configuration of a prior art toner bottle 420 while FIG. 2 shows a mouth portion 423 forming the outlet of the bottle 420. As shown, the bottle 420 is substantially cylindrical and provided with the mouth portion 423 at substantially the center of one end thereof. The mouth portion 423 has a smaller diameter than the cylinder constituting the bottle 420 and has a circular section. In the specific configuration, the mouth portion 423 is formed at the end of a collar 424 extending out from the cylinder 420 and is plugged by a lid 425. A mushroom-like lug 426 protrudes from the center of the lid 425 and is used as a handler for plugging or unplugging utility. A spiral guide groove 427 is formed in the inner periphery of the cylinder 420. When the bottle 420 is rotated about the longitudinal axis thereof, the spiral groove 427 guides the toner contained in the bottle 420 toward the mouth portion 423.

One disadvantage associated with the bottle 420, in particular, the lid 425, is that a user may accidentally nip the lug 426 of the lid 425, which, when the user uses enough force, may break the bottom portion of the lid 425 so as to cause toner falling from the bottle 420.

Suggestions or modifications were made to overcome this disadvantage. For example, as shown in FIG. 3, a lid 425 was provided with pin-like obstructions 426*b* around the lug 426. While the obstructions 426*b* may prevent the easy access of the person's fingers to the lug 426, a user may still reach the lug 426 and accidents may still occur.

Thus, there still is a need in the industry address the aforementioned deficiencies and inadequacies.

SUMMARY OF THE INVENTION

In one aspect, the present invention relates to a lid to selectively plug or unplug a discharge mouth of a developer container mounted to an image forming apparatus for replenishing a developer. In one embodiment of the present invention, the lid includes a body having a bottom portion and a sidewall portion defining an opening, wherein the bottom portion has an inner surface and an outer surface, and the sidewall portion has an inner surface and an outer surface. The lid further has a ring and a lug having a first end and a second end defining a body portion. Moreover, the lid has a plurality of arms connecting the lug and the ring, wherein the ring is sized to fit into a position at the sidewall portion such that when the ring is placed into the position, the second end of the lug and the inner surface of the bottom portion define a gap therebetween and the body portion of the lug facing away from the developer container when the lid plugs the discharge mouth. Thus, even if a user accidentally nips the lug away from the lid without using a corresponding collect chuck, no toner will be spilled because the bottom portion of the lid still covers the mouth portion. While only three arms are shown here, additional arms can be utilized as well.

Additionally, the body of the lid further has an engaging portion formed around the opening and extending outwardly from the sidewall portion and sized to engage the discharge mouth of a developer container when the lid plugs the discharge mouth. Furthermore, the sidewall portion of the body comprises a cylindrical portion and a conical portion, wherein the conical portion adjoins the cylindrical portion and the bottom portion. Moreover, the body has a plurality of annular ribs formed on the inner surface of the cylindrical portion.

The lug is substantially extending along a central axis of the ring. In one embodiment, the body portion of the lug has a larger diameter portion forming a conical recess therein proximate to the first end of the lug and a smaller diameter portion adjoining the larger diameter portion and the plurality of arms.

The ring has a first end with a larger diameter, a second end with a smaller diameter and an annular portion therebetween the first end and the second end. The arms are equiangularly from apart each other.

In another aspect, the present invention relates to a lid to selectively plug or unplug a discharge mouth of a developer container mounted to an image forming apparatus for replenishing a developer. In one embodiment of the present invention, the lid includes a body having a bottom portion and a sidewall portion defining an opening, wherein the bottom portion has an inner surface and an outer surface, and the sidewall portion has an inner surface and an outer surface. The lid further includes a lug that has a first end and a second end defining a body portion with a center axis. Additionally, the lid has a plurality of arms projecting away from the center axis of the lug from the second end of the lug and engaging the sidewall portion such that the second end of the lug and the first surface of the bottom portion define a gap therebetween and the body portion of the lug facing away from the developer container when the lid plugs the discharge mouth. Again, even if a user accidentally nips the lug away from the lid without using a corresponding collect chuck, no toner will be spilled because the bottom portion of the lid still covers the mouth portion.

The body of the lid further has an engaging portion formed around the opening and extending outwardly from the sidewall portion and sized to engage the discharge mouth of a developer container when the lid plugs the discharge mouth. The sidewall portion of the body has a cylindrical portion and a conical portion, wherein the conical portion adjoins the cylindrical portion and the bottom portion. Moreover, the body has a plurality of annular ribs formed on the inner surface of the cylindrical portion.

The body portion of the lug includes a first plate portion with a diameter, a second plate portion with a diameter, and a cylindrical portion with a diameter therebetween and the diameter of cylindrical portion is smaller than both of the diameters of the first plate portion and the second plate portion, wherein the diameters of the first plate portion and the second plate portion are substantially equal.

The arms are extending away from the second plate and equiangularly apart from each other. While only three arms are shown here, additional arms can be utilized as well. The body further has a plurality of projections correspondingly located at the inner surface of the sidewall portion so as to engage with the plurality of arms. In one embodiment, each of the arms defines a hole at an end away from the second plate, and each of the projections has a corresponding pin portion to be received in a hole of a corresponding arm so as to engage with the corresponding arms.

In a further aspect, the present invention relates to a lid to selectively plug or unplug a discharge mouth of a developer container mounted to an image forming apparatus for replenishing a developer. In one embodiment of the present invention, the lid includes a body having a bottom portion and a sidewall portion defining an opening, wherein the bottom portion has an inner surface and an outer surface, and the sidewall portion has an inner surface and an outer surface. The lid additionally includes a lug having a first end and a second end defining a body portion, wherein the lug is engaged with the body at a position at the sidewall portion such that the second end of the lug and the first surface of the bottom portion define a gap therebetween and the body portion of the lug facing away from the developer container when the lid plugs the discharge mouth.

Moreover, the lid further has a plurality of arms projecting away from a center axis of the lug and engaging with the sidewall portion of the body.

Alternatively, the body portion of the lug has a first plate portion and a second plate portion and a cylindrical portion defined therebetween, and a plurality of arms extending away from the second plate portion so as to engage with the sidewall portion of the body.

These and other aspects will become apparent from the following description of the preferred embodiment taken in conjunction with the following drawings, although variations and modifications therein may be affected without departing from the spirit and scope of the novel concepts of the disclosure.

DETAILED DESCRIPTION OF THE FIGURES OF THE DRAWINGS

The accompanying drawings, which are incorporated in and constitute a part of this specification, illustrate various embodiments of the invention and together with the description, serve to explain the principals of the invention.

DETAILED DESCRIPTION OF THE, INVENTION

Figure 1:
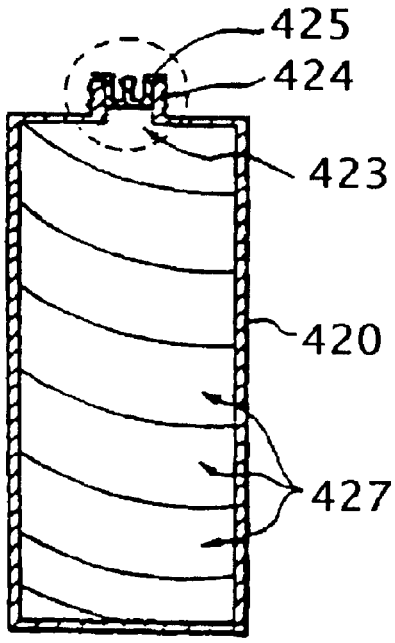
Fig. 1 ( Prior Art )
FIG. 1 (prior art) is a side view of a toner container with a prior art lid for use with an image forming apparatus for replenishing a developer.
Figure 2:
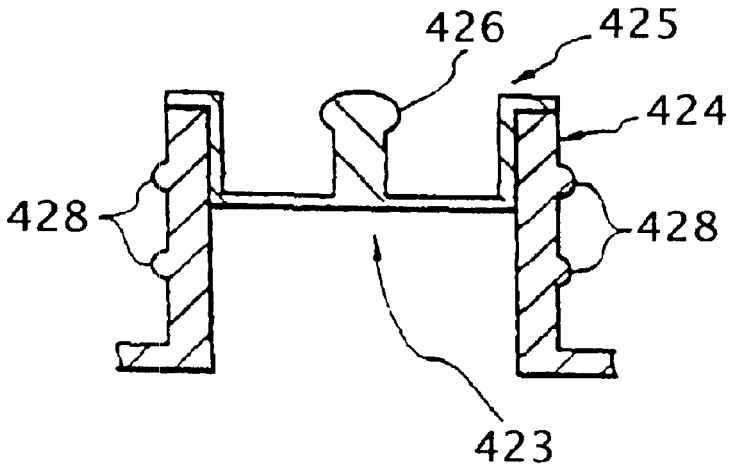
Fig. 2 ( Prior Art )
FIG. 2 (prior art) is a fragmentary enlarged view of the mouth portion of the toner container of FIG. 1.
Figure 3:
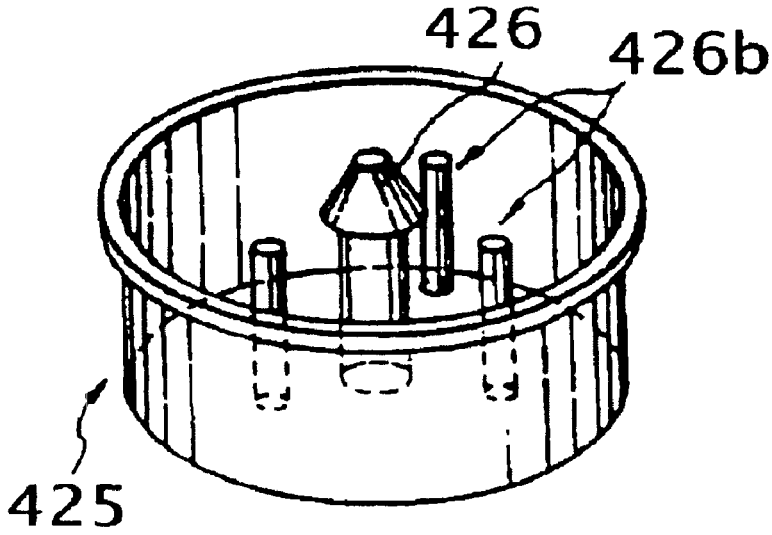
Fig. 3 (Prior Art)
FIG. 3 (prior art) is a perspective view of a configuration of a prior art lid.

The present invention is more particularly described-in the following examples that are intended to be illustrative only since numerous modifications and variations therein will be apparent to those skilled in the art. Various embodiments of the invention are now described in detail. Referring to the drawings, like numbers indicate like parts throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

The description will be made as to the embodiments of the present invention in conjunction with the accompanying drawings. In accordance with the purposes of this invention, as embodied and broadly described herein, this invention, in one aspect, relates to a toner supplying container detachably mountable to an image forming apparatus.

Figure 4:
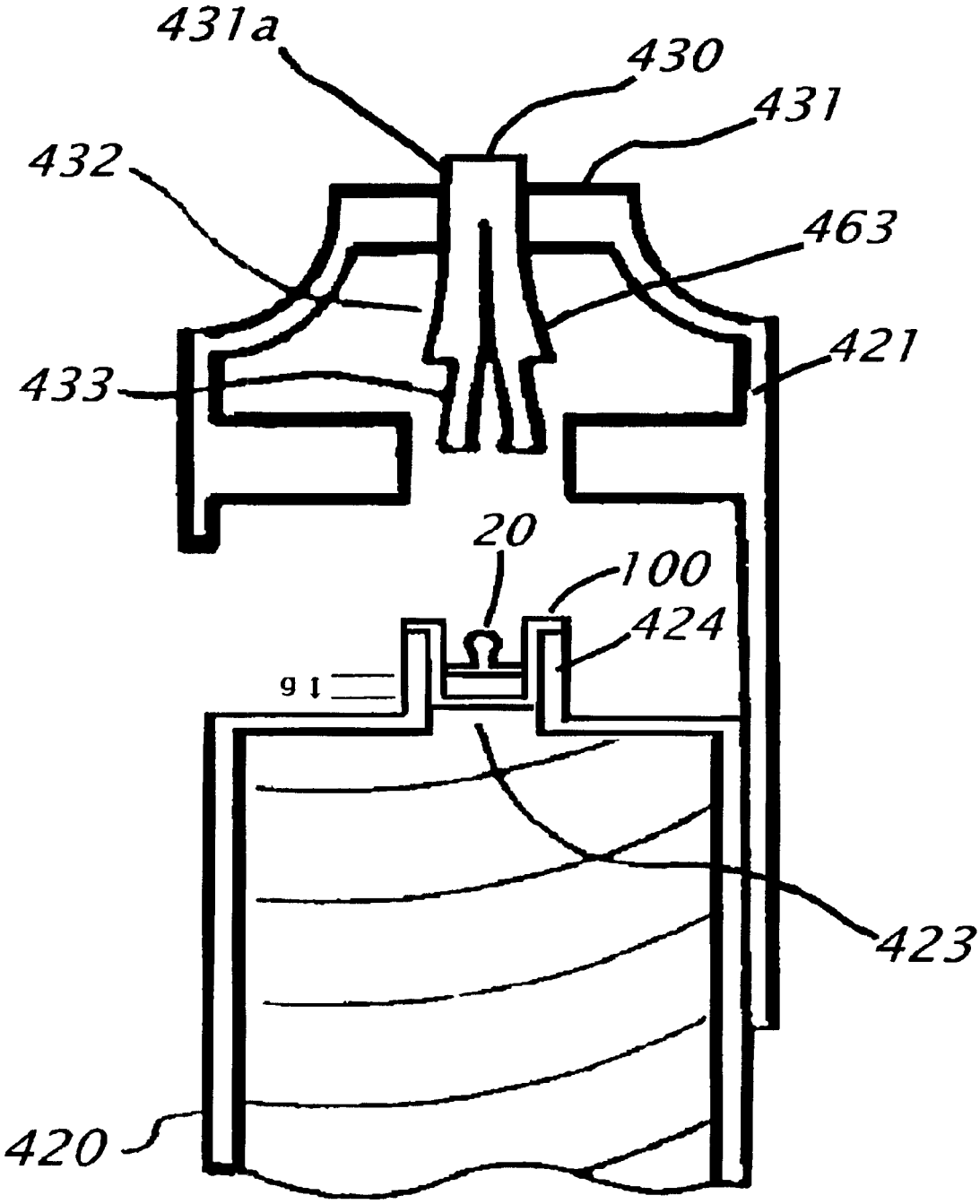
FIG. 4 shows a side view for unplugging a lid from a toner container with a lid according to one embodiment of the present invention.

Referring in general to FIGS. 4–12, and in particular to FIG. 4 first, a developer container 420 in one embodiment shows a mouth portion 423, forming the outlet of the bottle 420. As shown, the bottle 420 is substantially cylindrical and provided with the mouth portion 423 at substantially the center of one end thereof. The mouth portion 423 has a smaller diameter than the cylinder constituting the bottle 420 and has a circular section. In the specific configuration, the mouth portion 423 is formed at the end of a collar 424 extending out from the cylinder 420 and is plugged by a lid 100.

In operation, still referring to FIG. 4, a mechanism 432 is utilized for removing the lid 100 from the mouth portion 423 of the bottle 420. As shown, the mechanism 432 is made up of a collect chuck, or retaining means, 430 and moving means, not shown, for moving the chuck 430 toward and away from the bottle 420. The collect chuck 430 has a chucking portion 433 at the tip thereof and is supported by a hole 431*a* formed in a wall 431 which forms a part of a bottle holder 421. When the collect chuck 430 is in a free state, the chucking portion 433 is held open, as shown in FIG. 4. In operation, the bottle 420 is put in a predetermined position on the bottle holder 421. When the collect chuck 430 is moved away from the bottle 420 by the moving means, the peripheral larger diameter portion of the chuck 430 is pressed by the wall of the hole 431*a* with the result that the chucking portion 433 is squeezed to retain the lug 20 of the lid 100. Subsequently, the chuck 430 moves the lid 100 to a position where the mouth portion 423 of the bottle 420 is fully uncovered, chucking the lug 20 of the lid 100. In this way, the lid 100 can be utilized to selectively plug or unplug a discharge mouth of a toner or developer container that can be mounted to an image forming apparatus (not shown) for replenishing a developer or toner.

Referring now to FIGS. 5–8, a lid 100 to-selectively plug or unplug a discharge mouth of a developer container mounted to an image forming apparatus for replenishing a developer according to one embodiment of the present invention is shown. The lid 100 includes a body 10 that has a bottom portion 11 and a sidewall portion 17 defining an opening 18, wherein the bottom portion 11 has an inner surface 13 and an outer surface 15, and the sidewall portion 17 has an inner surface 19 and an outer surface 21.

Figure 5:
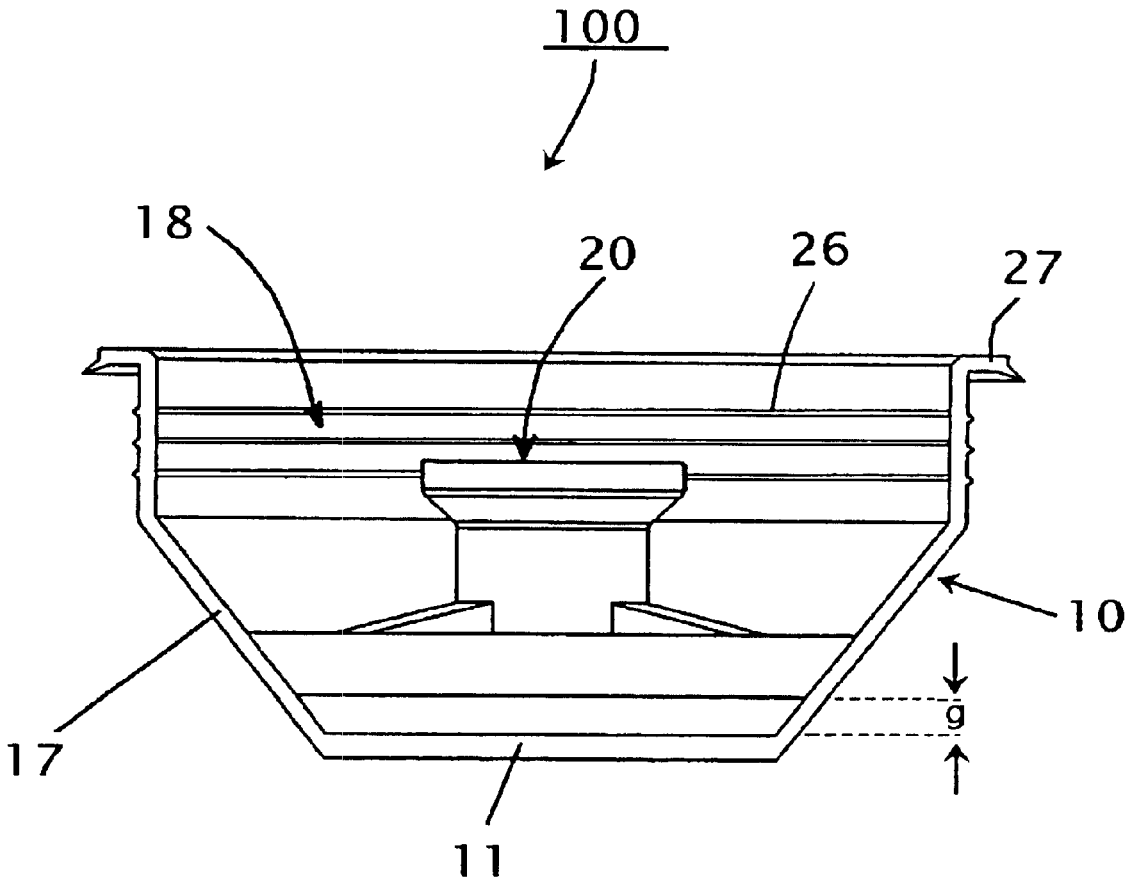
FIG. 5 is a side view of a lid according to one embodiment of the present invention.
Figure 6:
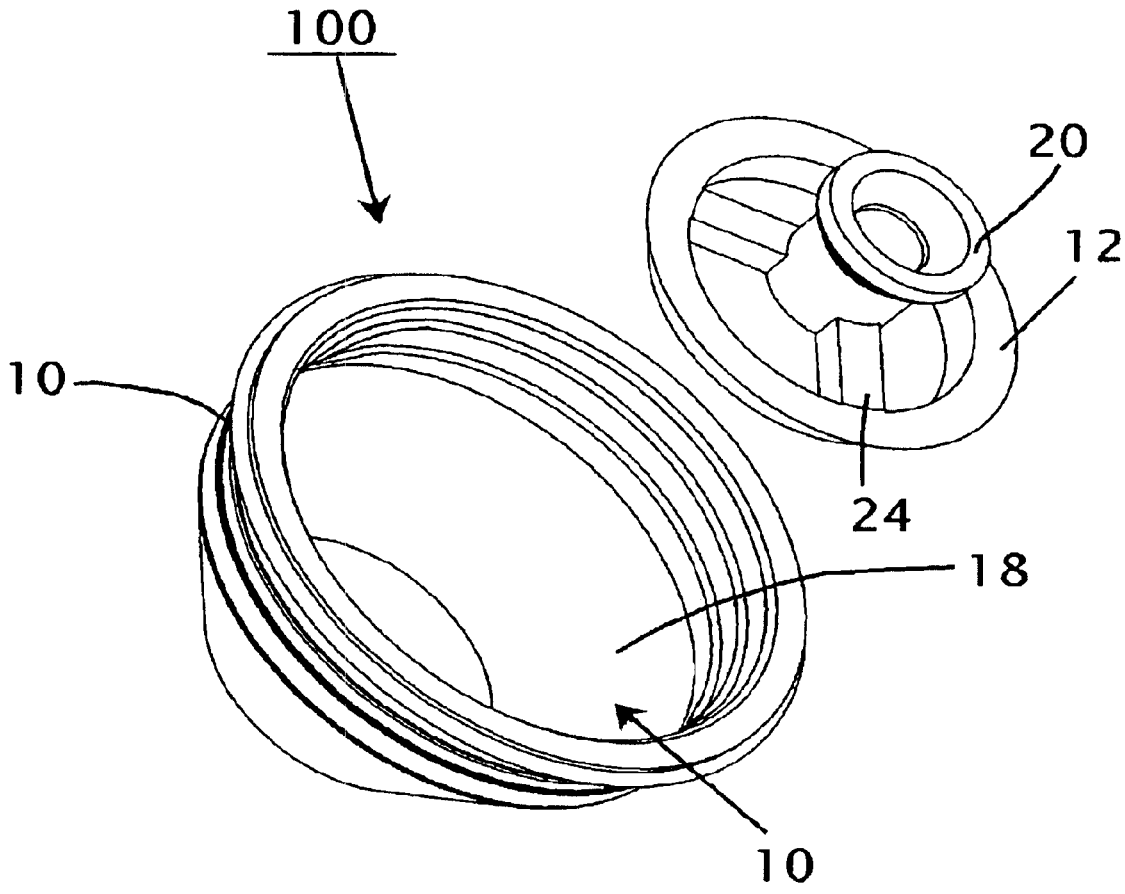
FIG. 6 is an exploded perspective view of the lid of FIG. 5.
Figure 7:
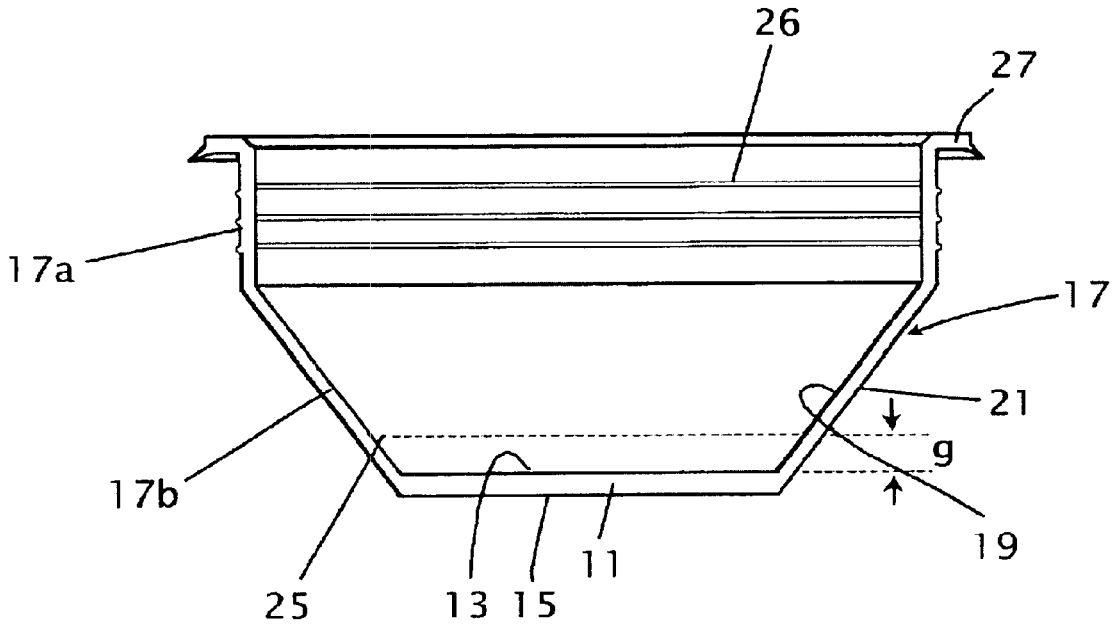
FIG. 7 is a side partial view of the lid of FIG. 5.

The lid 100 further has a ring 12 and a lug 20 having a first end 21 and a second end 23 defining a body portion 22. Additionally, the lid 100 has a plurality of arms 24 connecting the lug 20 and the ring 12, wherein the ring 12 is sized to fit into a predetermined position 25 at the sidewall portion 17 such that when the ring 12 is placed into the position 25, the second end 23 of the lug 20 and the inner surface 13 of the bottom portion 11 define a gap g therebetween, as best shown in. FIGS. 5 and 7, and the body portion 22 of the lug 20 facing away from the developer container when the lid 100 plugs the discharge mouth. In this configuration, there is also a gap between the bottom of the ring 12 and the inner surface 13 of the bottom portion 11 of the lid 100. In other words, even if the portions containing the ring 12, the lug 20 and the arms 24, as shown in FIG. 6, were taken away from the body portion 11 of the lid 100, the body portion 11 of the lid 100 would be sufficient to cover the mouth portion 423 of the bottle 420 to prevent the spill of the toner inside the bottle 420. Thus, even if a user accidentally nips the lug 20 away from the lid 100 without using a corresponding collect chuck, no toner will be spilled because the bottom portion 11 of the lid still covers the mouth portion 423.

The ring 20 can be fixedly positioned to the predetermined position 25 by ultrasonic welding, heat welding, or molding such that the lid 100 has an integral structure with sufficient mechanical strength to perform properly.

Referring now to FIGS. 5 and 7, the body 10 of the lid 100 further has an engaging portion 27 formed around the opening 18 and extending outwardly from the sidewall portion 17. The engaging portion 27 is sized to engage the discharge mouth 424 of a developer container 420 when the lid 100 plugs the discharge mouth 424. As shown in FIG. 7, the sidewall portion 17 of the body 10 has a cylindrical portion 17*a* and a conical portion 17*b*, wherein the conical portion 17*b* adjoins the cylindrical portion 17*a* and the bottom portion 11. The body 10 has a plurality of annular ribs 26 formed on the inner surface 19 of the cylindrical portion 17*a*.

Figure 8:
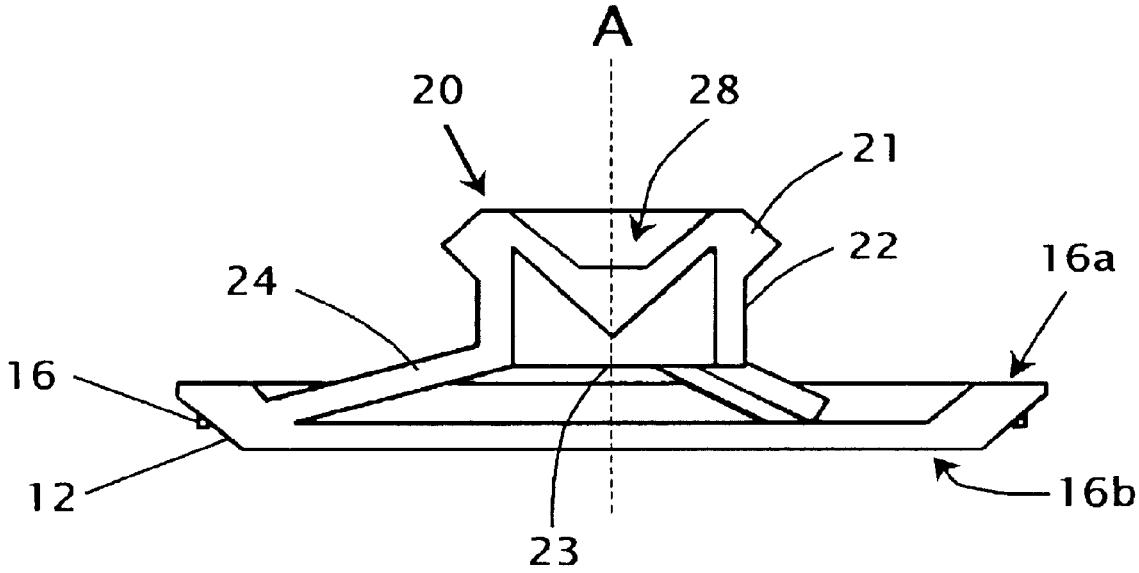
FIG. 8 is a side partial view of the lid of FIG. 5.
Figure 9:
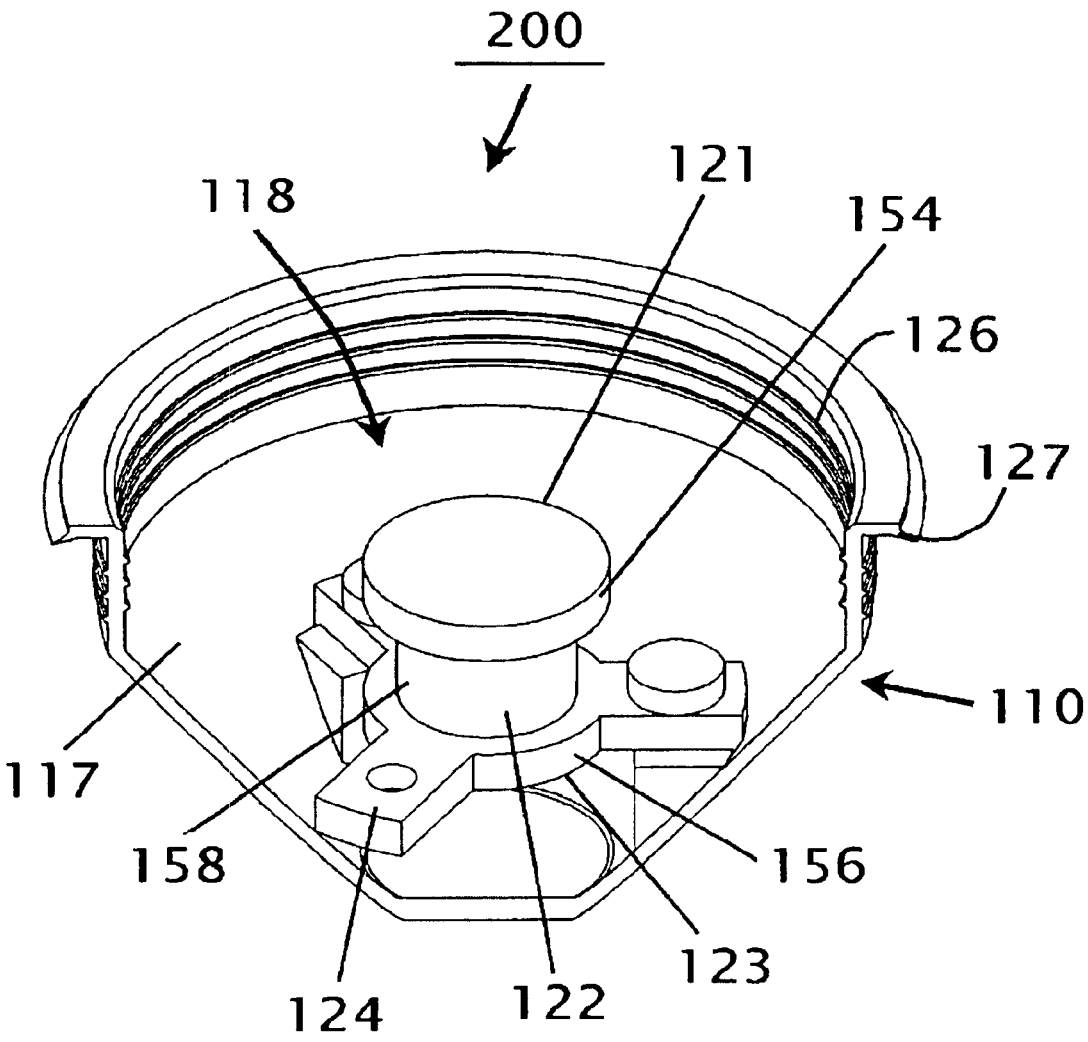
FIG. 9 is a side view of a lid according to another embodiment of the present invention.

Referring now to FIG. 8, the lug 20 is substantially extending along a central axis A of the ring 12. The body portion 22 of the lug 20 has a larger diameter portion forming a conical recess 28 therein proximate to the first end 21 of the lug 20 and a smaller diameter portion adjoining the larger diameter portion and the plurality of arms 24. The ring 12 has a first end 16*a* with a larger diameter, a second end 16*b* with a smaller diameter and an annular portion 16 therebetween the first end 16*a* and the second end 16*b*. As shown in FIG. 6, arms 24 are equiangularly from apart each other.

Figure 10:
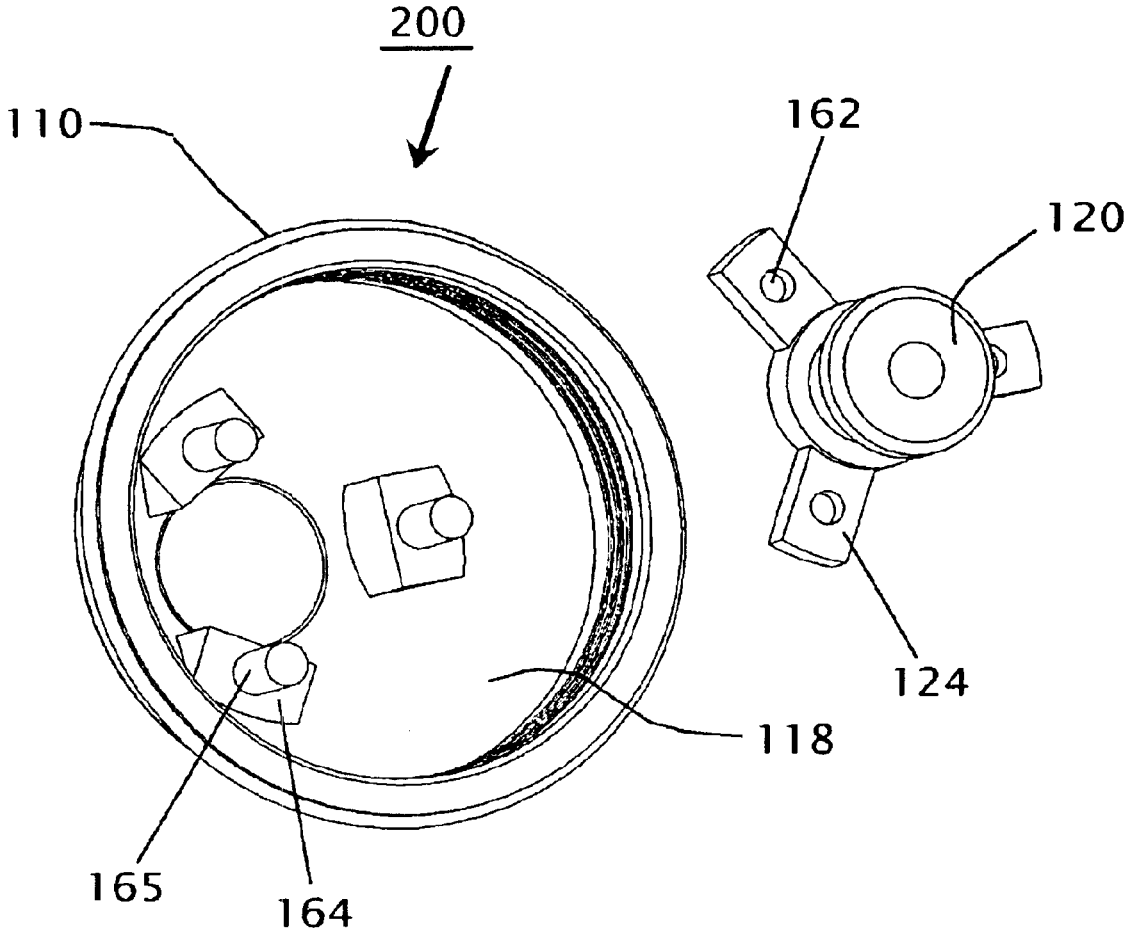
FIG. 10 is an exploded perspective view of the lid of FIG. 9.
Figure 11:
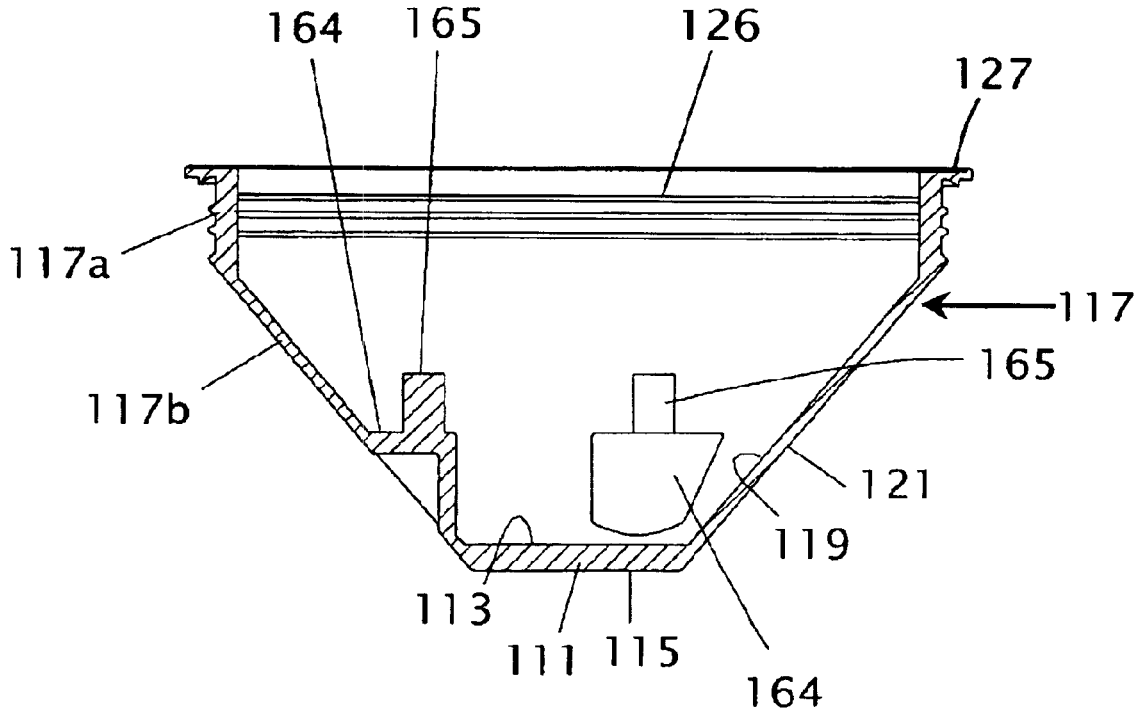
FIG. 11 is a side partial view of the lid of FIG. 9.
Figure 12:
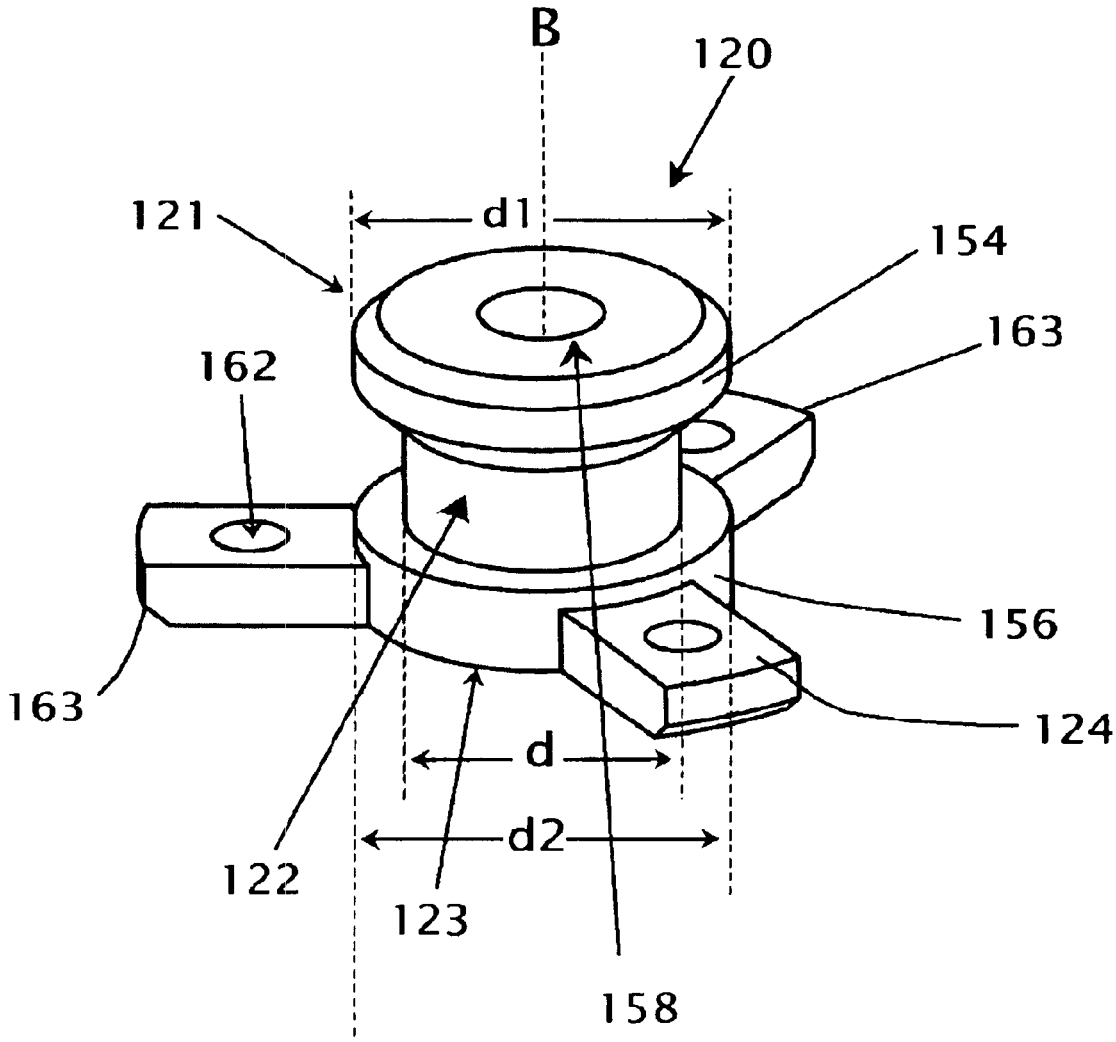
FIG. 12 is a perspective partial view of the lid of FIG. 9.

Referring now to FIGS. 9–12, a lid 200 to selectively plug or unplug a discharge mouth of a developer container mounted to an image forming apparatus for replenishing a developer according to one embodiment of the present invention is shown. The lid 200 includes a body 110, as shown in FIGS. 10 and 11, that has a bottom portion 111 and a sidewall portion 117 defining an opening 118, wherein the bottom portion 111 has an inner surface 113 and an outer surface 115, and the sidewall portion 117 has an inner surface 119 and an outer surface 121. The lid 200 further includes a lug 120, as shown in FIGS. 10 and 12, that has a first end 121 and a second end 123 defining a body portion 122 with a center axis B, and a plurality of arms 124 projecting away from the center axis B of the lug 120 from the second end 123 of the lug 120 and engaging the sidewall portion 117 such that the second end 123 of the lug 120 and the first surface 113 of the bottom portion 111 define a gap $g_2$ therebetween and the body portion 122 of the lug 120 facing away from the developer container when the lid 200 plugs the discharge mouth.

Referring now to FIG. 11, the body 110 of the lid 200 further has an engaging portion 127 that is formed around the opening 118 and extending outwardly from the sidewall portion 117. The engaging portion 127 is sized to engage the discharge mouth of a developer container when the lid 200 is used to plug the discharge mouth 424 of the toner bottle 420. The sidewall portion 117 of the body 110 has a cylindrical portion 117*a* and a conical portion 117*b*, wherein the conical portion 117*b* adjoins the cylindrical portion 117*a* and the bottom portion 111. Additionally, the body 110 has a plurality of annular ribs 126 formed on the inner surface 119 of the cylindrical portion 117*a*.

Furthermore, as shown in FIG. 12, the body portion 122 of the lug 120 includes a first plate portion 154 with a diameter $d_1$, a second plate portion 156 with a diameter $d_2$, and a cylindrical portion 158 with a diameter d therebetween. The diameter d of cylindrical portion 158 is smaller than both of the diameters $d_1$, $d_2$ of the first plate portion 154 and the second plate portion 156. In the embodiment shown, the diameters $d_1$, $d_2$ of the first plate portion and the second plate portion are substantially equal. Alternatively, they can be different.

Referring now to FIG. 10, the plurality of arms 124 are extending away from the second plate 156 and equiangularly apart from each other. The body 110 further has a plurality of projections 164 correspondingly located at the inner surface 119 of the sidewall portion 117 so as to engage with the plurality of arms 124. As shown in FIGS. 10 and 12, in one embodiment, each of the arms 124 defines a hole 162 at an end 163 away from the second plate 156, and each of the projections 164 has a corresponding pin portion 165 to be received in a hole 162 of a corresponding arms 124 so as to engage with the corresponding arms 124. Alternatively, ultrasonic welding, heat welding, or molding can be utilized to form a lid 200 that has a configuration as disclosed herein and an integral structure with sufficient mechanical strength to perform properly.

In operation, either of the lid 100 and lid 200 can be utilized in cooperation with a toner bottle such as one is shown in FIG. 4.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modification, both as to equipment details and operating procedures can be effected without departing from the scope of the invention itself. Further, it should be understood that, although the present invention has been described with reference to specific details of certain embodiments thereof, it is not intended that such details should be regarded as limitations upon the scope of the invention except as and to the extent that they are included in the accompanying claims.

What is claimed is:

1. A lid to selectively plug or unplug a discharge mouth of a developer container mounted to an image forming apparatus for replenishing a developer, comprising:

a body having a bottom portion and a sidewall portion defining an opening, wherein the bottom portion has an inner surface and an outer surface, and the sidewall portion has an inner surface and an outer surface;

a ring;

a lug having a first end and a second end defining a body portion; and a plurality of arms connecting the lug and the ring, wherein the ring is sized to fit into a position at the sidewall portion such that when the ring is placed into the position, the second end of the lug and the inner surface of the bottom portion define a gap therebetween so that there is no contact between the second end of the lug and the bottom portion and the body portion of the lug facing away from the developer container when the lid plugs the discharge mouth.

2. The lid of claim 1, wherein the body of the lid further comprises an engaging portion formed around the opening and extending outwardly from the sidewall portion and sized to engage the discharge mouth of a developer container when the lid plugs the discharge mouth.

3. The lid of claim 1, wherein the sidewall portion of the body comprises a cylindrical portion and a conical portion, wherein the conical portion adjoins the cylindrical portion and the bottom portion.

4. The lid of claim 3, wherein the body has a plurality of annular ribs formed on the inner surface of the cylindrical portion.

5. The lid of claim 1, wherein the lug is substantially extending along a central axis of the ring.

6. The lid of claim 1, wherein the body portion of the lug has a larger diameter portion forming a conical recess therein proximate to the first end of the lug and a smaller diameter portion adjoining the larger diameter portion and the plurality of arms.

7. The lid of claim 1, wherein the ring has a first end with a larger diameter, a second end with a smaller diameter and an annular portion therebetween the first end and the second end.

8. The lid of claim 1, wherein the plurality of arms are equiangularly from apart each other.

9. A lid to selectively plug or unplug a discharge mouth of a developer container mounted to an image forming apparatus for replenishing a developer, comprising:

a body having a bottom portion and a sidewall portion defining an opening, wherein the bottom portion has an inner surface and an outer surface, and the sidewall portion has an inner surface and an outer surface;

a lug having a first end and a second end defining a body portion with a center of axis; and a plurality of arms projecting away from a center axis of the lug from the second end of the lug and engaging the sidewall portion such that the second end of the lug and the inner surface of the bottom portion define a gap therebetween so that there is no contact between the second end of the lug and the bottom portion and the body portion of the lug facing away from the developer container when the lid plugs the discharge mouth.

10. The lid of claim 9, wherein the body of the lid further comprises an engaging portion formed around the opening and extending outwardly from the sidewall portion and sized to engage the discharge mouth of a developer container when the lid plugs the discharge mouth.

11. The lid of claim 9, wherein the sidewall portion of the body comprises a cylindrical portion and a conical portion, wherein the conical portion adjoins the cylindrical portion and the bottom portion.

12. The lid of claim 11, wherein the body has a plurality of annular ribs formed on the inner surface of the cylindrical portion.

13. The lid of claim 9, wherein the body portion of the lug comprises a first plate portion with a diameter, a second plate portion with a diameter, and a cylindrical portion with a diameter therebetween and the diameter of cylindrical portion is smaller than both of the diameters of the first plate portion and the second plate portion.

14. The lid of claim 13, wherein the diameters of the first plate portion and the second plate portion are substantially equal.

15. The lid of claim 9, wherein the plurality of arm are extending away from the second plate and equiangularly apart from each other.

16. The lid of claim 9, wherein the body further comprises a plurality of projections correspondingly located at the inner surface of the sidewall portion so as to engage with the plurality of arms.

17. The lid of claim 9, wherein each of the arms defines a hole at an end away from the second plate, and each of the projections has a corresponding pin portion to be received in a hole of a corresponding arm so as to engage with the corresponding arm.

18. A lid to selectively plug or unplug a discharge mouth of a developer container mounted to an image forming apparatus for replenishing a developer, comprising:

a body having a bottom portion and a sidewall portion defining an opening, wherein the bottom portion has an inner surface and an outer surface, and the sidewall portion has an inner surface and an outer surface; and a lug having a first end and a second end defining a body portion, wherein the lug is engaged with the body at a position at the sidewall portion such that the second end of the lug and the inner surface of the bottom portion define a gap therebetween so that there is no contact between the second end of the lug and the bottom portion and the body portion of the lug facing away from the developer container when the lid plugs the discharge mouth.

19. The lid of claim 18, wherein the lid further comprises a plurality of arms projecting away from a center axis of the lug and engaging with the sidewall portion of the body.

20. The lid of claim 18, wherein the body portion of the lug comprises a first plate portion and a second plate portion and a cylindrical portion defined therebetween, and a plurality of arms extending away from the second plate portion so as to engage with the sidewall portion of the body.

* * * * *